US010280685B2

(12) United States Patent
Sonar et al.

(10) Patent No.: US 10,280,685 B2
(45) Date of Patent: May 7, 2019

(54) HYBRID DOWNHOLE MOTOR WITH ADJUSTABLE BEND ANGLE

(71) Applicant: Halliburton Energy Services, Inc., Houston, TX (US)

(72) Inventors: Sandip Satish Sonar, Edmonton (CA); Vishwajit Manajirao Ghatge, Pune (IN); Nitinkumar Pandurang Katke, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 163 days.

(21) Appl. No.: 15/502,417

(22) PCT Filed: Sep. 16, 2014

(86) PCT No.: PCT/US2014/055891
§ 371 (c)(1),
(2) Date: Feb. 7, 2017

(87) PCT Pub. No.: WO2016/043719
PCT Pub. Date: Mar. 24, 2016

(65) Prior Publication Data

US 2017/0234072 A1 Aug. 17, 2017

(51) Int. Cl.

| | |
|---|---|
| ***E21B 7/08*** | (2006.01) |
| ***E21B 7/06*** | (2006.01) |
| ***E21B 4/02*** | (2006.01) |
| ***E21B 4/00*** | (2006.01) |
| ***E21B 47/024*** | (2006.01) |

(Continued)

(52) U.S. Cl.
CPC ..... *E21B 7/068* (2013.01); *E21B 4/003* (2013.01); *E21B 4/02* (2013.01); *E21B 7/062* (2013.01); *E21B 47/024* (2013.01); *E21B 44/00* (2013.01); *E21B 47/12* (2013.01)

(58) Field of Classification Search
CPC ..... E21B 7/068; E21B 4/003; E21B 47/024; E21B 4/02; E21B 7/062; E21B 44/00; E21B 47/12
See application file for complete search history.

(56) References Cited

U.S. PATENT DOCUMENTS

| | | | |
|---|---|---|---|
| 4,067,404 | A | 1/1978 | Crase |
| 4,077,657 | A | 3/1978 | Trzeciak |
| 4,884,643 | A | 12/1989 | Wawrzynowski et al. |

(Continued)

OTHER PUBLICATIONS

International Search Report and Written Opinion issued in related PCT Application No. PCT/US2014/055891 dated Jun. 12, 2015, 14 pages.

(Continued)

*Primary Examiner* — Brad Harcourt
(74) *Attorney, Agent, or Firm* — Alan Bryson; Baker Botts L.L.P.

(57) ABSTRACT

An example downhole motor may include a first housing and a second housing with first and second portions characterized by non-parallel longitudinal axes. The second housing may be rotatably coupled to the first housing, and the first portion of the second housing may be arranged in a fixed, non-parallel longitudinal orientation with the first housing. A drive shaft may be at least partially within the first housing, and the motor may further comprise a selectively engageable torque coupling between the drive shaft and the second housing, positioned within the first housing.

17 Claims, 5 Drawing Sheets

(51) Int. Cl.

| | |
|---|---|
| *E21B 44/00* | (2006.01) |
| *E21B 47/12* | (2012.01) |

(56) References Cited

U.S. PATENT DOCUMENTS

| | | | |
|---|---|---|---|
| 5,135,059 | A | 8/1992 | Turner et al. |
| 5,899,281 | A | 5/1999 | von Gynz-Rekowski |
| 6,554,083 | B1 | 4/2003 | Kerstetter |
| RE39,970 | E | 1/2008 | Askew |
| 7,882,904 | B2 | 2/2011 | von Gynz-Rekowski et al. |
| 2009/0275415 | A1 | 11/2009 | Prill et al. |
| 2014/0251695 | A1 | 9/2014 | Marchand et al. |

OTHER PUBLICATIONS

International Preliminary Report on Patentability issued in related PCT Application No. PCT/US2014/055891 dated Oct. 24, 2016, 5 pages.

HYBRID DOWNHOLE MOTOR WITH ADJUSTABLE BEND ANGLE

CROSS-REFERENCE TO RELATED APPLICATION

The present application is a U.S. National Stage Application of International Application No. PCT/US2014/055891 filed Sep. 16, 2014, which is incorporated herein by reference in its entirety for all purposes.

BACKGROUND

The present disclosure relates generally to well drilling operations and, more particularly, to directional drilling in hydrocarbon recovery operations.

Hydrocarbon recovery operations typically utilize a drill bit to bore through a subterranean rock formation until a hydrocarbon reservoir is reached. In certain drilling operations, a motor coupled to the drill bit and located within a subterranean rock formation may provide torque to the drill bit. Example motors may be used in directional drilling operations, where the hydrocarbon reservoirs are more difficult to reach, and where it is necessary to precisely locate the drill bit—vertically and horizontally—in the formation. Directional drilling operations require control of the direction in which the drill bit is pointed, either to avoid particular formations or to intersect formations of interest.

FIGURES

Some specific exemplary embodiments of the disclosure may be understood by referring, in part, to the following description and the accompanying drawings.

Figure 1:
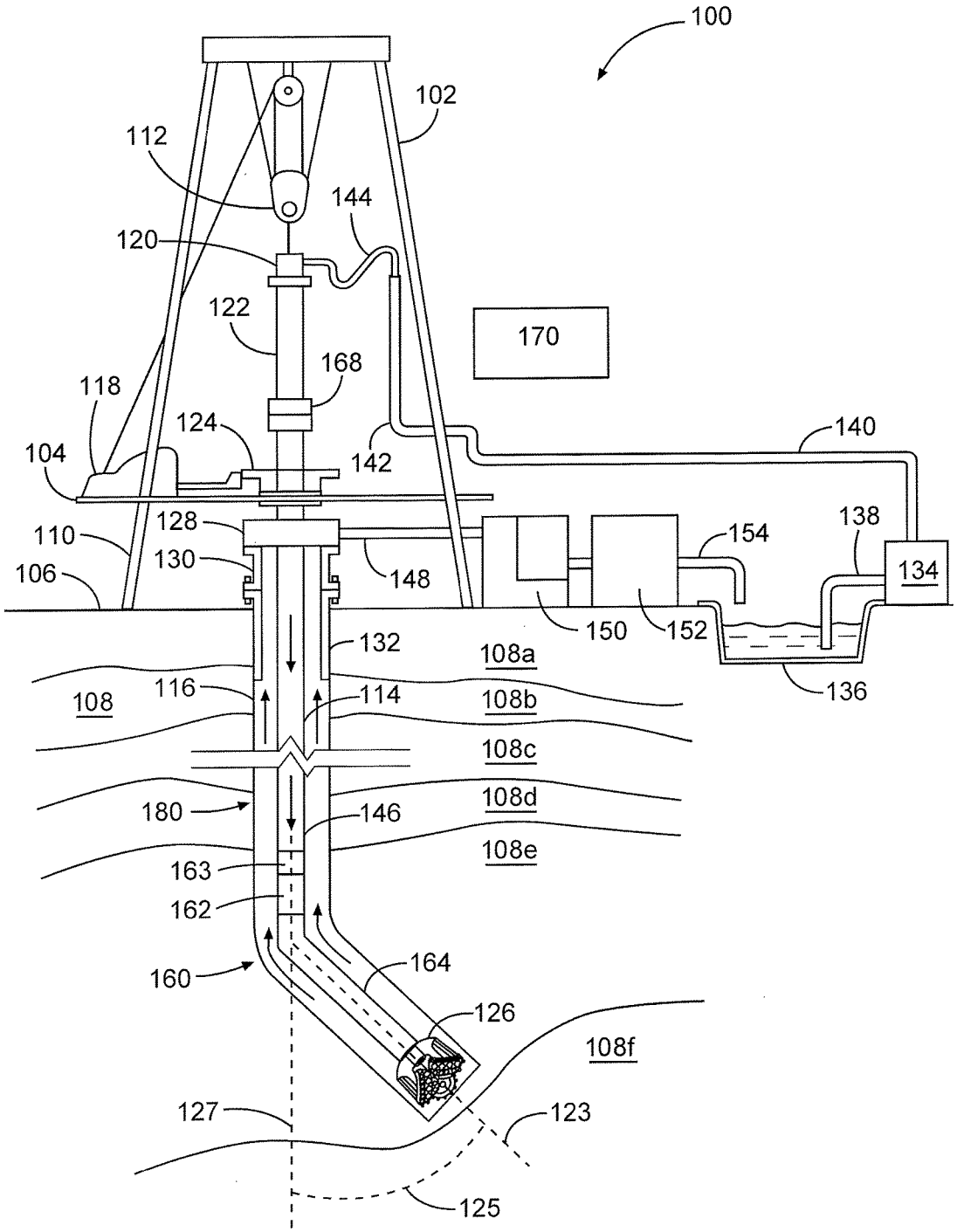
FIG. 1 is a diagram of an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

FIG. 1 is a diagram illustrating an example drilling system 100, according to aspects of the present disclosure. In the embodiment shown, the system 100 comprises a derrick 102 mounted on a floor 104 that is in contact with the surface 106 of a formation 108 through supports 110. The formation 108 may be comprised of a plurality of rock strata 108*a-f*, each of which may be made of different rock types with different characteristics. At least one of the rock strata 108*a-f* may contain hydrocarbons and may be a "target" formation to which the drilling system 100 is being directed. Although the system 100 comprises an "on-shore" drilling system in which floor 104 is at or near the surface, similar "off-shore" drilling systems are also possible and may be characterized by the floor 104 being separated from the surface 106 by a volume of water.

The derrick 102 may comprise a traveling block 112 for raising or lowering a drilling assembly 180 at least partially disposed within a borehole 116 in the formation 108. A motor 118 may control the position of the traveling block 112 and, therefore, the drilling assembly 180. A swivel 120 may be connected between the traveling block 112 and a kelly 122, which supports the drilling assembly 180 as it is lowered through a rotary table 124. The drilling assembly 180 may comprise a drill string 114, a bottom hole assembly (BHA) 160, and a drill bit 126. The drill string 114 may comprise a plurality of pipe segments threadedly connected. The BHA 160 may comprise a measurement-while-drilling/logging while drilling (MWD/LWD) tool 162, downhole motor 164, and a telemetry system 163. The LWD/MWD tool 162 may comprise multiple sensors through which measurements of the formation 108 may be taken, and may be coupled to the drill string 114 through the telemetry system 163. The downhole motor 164 may be coupled to the drill bit 126, and to the drill string 114 through the MWD/LWD tool 162 and the telemetry system 163. The drill bit 126 may be coupled to the drill string 114 via the BHA 160, and may be driven by the downhole motor 164 and/or rotation of the drill string 114 by the rotary table 124.

In certain embodiments, the drilling system 100 may further comprise a control unit 170 positioned at or near the surface 106. The control unit 170 may comprise an information handling system that may communicate with the BHA 160 through the telemetry system 163. In certain embodiments, one or more signals may be communicated between the telemetry system 163 and the control unit 170 via mud pulses, wireless communications channels, or wired communications channels. In the embodiment shown, a signal transmitted from the telemetry signal may be received at the surface receiver 168, to which the control unit 170 is communicably coupled.

The telemetry system 163 may be communicably coupled to at least one element of the BHA 160, including the downhole motor 164 and the MWD/LWD tool 162. Signals transmitted from the control unit 170 to one of the downhole motor 164 and the MWD/LWD tool 162 may be received and decoded at the telemetry system 163, and transmitted within the BHA 160. The signals may be intended to alter the operation or state of one of the downhole motor 164 and the MWD/LWD tool 162. For example, a signal may be intended to cause the MWD/LWD tool 162 to take measurements within at a certain frequency, to alter a speed of the downhole motor 164, or to cause the downhole motor 164 to alter the direction of the drill bit 126, as will be described in greater detail below. In certain embodiments, the BHA 160 may comprise a controller or processor (not shown), such as a microcontroller or integrated processor, that controls the operation of at least one of the downhole motor 164 and the MWD/LWD tool 162.

The drill string 114 may extend downwardly through a bell nipple 128, blow-out preventer (BOP) 130, and wellhead 132 into the borehole 116. The wellhead 132 may include a portion that extends into the borehole 116. In certain embodiments, the wellhead 132 may be secured within the borehole 116 using cement. The BOP 130 may be coupled to the wellhead 132 and the bell nipple 128, and may work with the bell nipple 128 to prevent excess pressures from the formation 108 and borehole 116 from being released at the surface 106. For example, the BOP 130 may comprise a ram-type BOP that closes the annulus between the drill string 114 and the borehole 116 in case of a blowout.

During drilling operations, drilling fluid, such as drilling mud, may be pumped into and received from a borehole 116. Specifically, the drilling system may include a mud pump 134 that may pump drilling fluid from a reservoir 136 through a suction line 138 into an inner bore of the drill string 114 at the swivel 120 through one or more fluid conduits, including flow pipe 140, stand-pipe 142, and kelly hose 144. As used herein, a fluid conduit may comprise any pipe, hose, or general fluid channel through which drilling fluid can flow. Once introduced at the swivel 120, the drilling mud then may flow downhole through the drill string 114 and BHA 160, exiting at the drill bit 126 and returning up through an annulus 146 between the drill string 114 and the borehole 116 in an open-hole embodiments, or between the drill string 114 and a casing (not shown) in a cased borehole embodiment. The annulus 146 is created by the rotation of the drill bit 126 in borehole 116 and is defined as the space between the interior/inner wall or diameter of borehole 104 and the exterior/outer surface or diameter of the drill string 106. While in the borehole 116, the drilling mud may capture fluids and gases from the formation 108 as well as particulates or cuttings that are generated by the drill bit 126 engaging with the formation 108. The drilling fluid then may flow to fluid treatment mechanisms 150 and 152 through a return line 148 after exiting the annulus 146 via the bell nipple 128.

In the embodiment shown, the downhole motor 164 may rotate the drill bit 126 to extend the borehole 116. In certain embodiments, the downhole motor 164 may comprise a mud motor that is driven by the circulation of drilling fluid through the drill string 116. The downhole motor 164 may convert the fluid flow into torque that is then transmitted to the drill bit 126. When the drill bit 126 rotates, it may engage with the formation 108, and extend the borehole 116. The speed with which the downhole motor 164 drives the drill bit 126 may be based, at least in part, on the flow rate of the drilling fluid through the downhole motor 164. Other types of downhole motors are possible, including, but not limited to, electric motors.

In certain directional drilling applications, it may be necessary to direct the drill bit 126 or drilling assembly 180 toward a target formation, which may contain hydrocarbons. Directing the drill bit 126 may comprise controlling an inclination of the drill bit 126, which may be characterized as the angle between a longitudinal axis 123 of the drill bit 126 and a reference plane, such as the surface 106, a plane perpendicular to the surface 106, a boundary between the formation strata, or another plane that would be appreciated by one of ordinary skill in the art in view of this disclosure. Establishing and maintaining the correct inclination can be difficult, however, given the sometimes extreme downhole operating conditions and the uncertainty regarding the locations and orientations of formation strata.

According to aspects of the present disclosure, the inclination of the drill bit 126 may be controlled by the downhole motor 164, which may comprise a bend angle 125 that is adjustable while the downhole motor 164 is positioned downhole. In the embodiment shown, the bend angle 125 comprises the angle between the longitudinal axis 123 of the drill bit 126, and the longitudinal axis 127 of the drill string 114. Adjusting the bend angle 125 alters the longitudinal axis 123 of the drill bit 126 with respect to the drill string 114, which functions to alter the inclination of the drill bit 126. Because the bend angle 125 of the downhole motor 164 can be adjusted downhole, the inclination of the drill bit 126 may be modified in real-time or near real-time in response to downhole measurements taken by the MWD/LWD apparatus 162, improving drilling accuracy and reducing drilling time.

Figure 2:
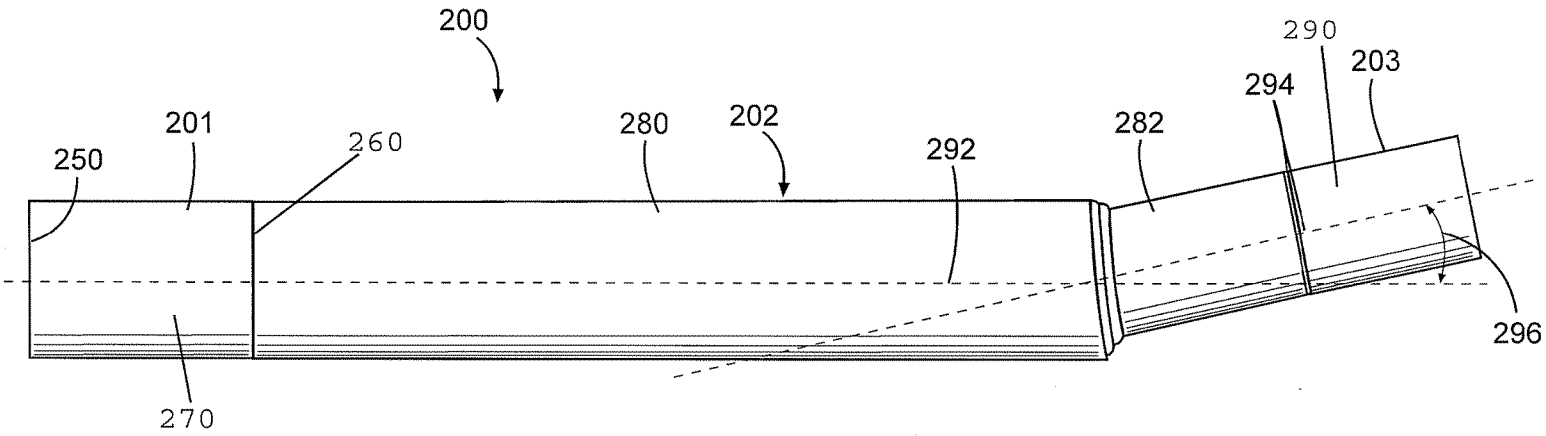
FIG. 2 is a diagram of an example downhole motor with an adjustable bend angle, according to aspects of the present disclosure.

FIG. 2 is a diagram of an example downhole motor 200 with an adjustable bend angle, according to aspects of the present disclosure. The downhole motor 200 may comprise a power assembly 201, a drive assembly 202, and a bearing assembly 203. Each of the assemblies 201-203 may comprise one or more respective housings that are coupled together, such as through threaded connections. In the embodiment shown, power assembly 201 comprises a housing 270 may be coupled directly or indirectly to a drill string at an interface 250. Also in the embodiment shown, the drive assembly 202 may comprise a first housing 280 and a second housing 282, with the first housing 280 coupled to the housing 270 at an interface 260 and the second housing 282 rotatably coupled to the first housing 280, as will be described in greater detail below. A housing 290 of the bearing assembly 203 may be coupled to the second housing 282 of the drive assembly 202, and the housing 290 may further be coupled to a drill bit (not shown) via a bit shaft (not shown) coupled to the housing 290. Although the motor 200 is described with respect to different segments, some or all of the assemblies and housings may be integrated.

The housing 270 of the power assembly 201 and the first housing 280 of the drive assembly 202 may share a fixed longitudinal axis 292. The housing 290 of the bearing section 203 may share a longitudinal axis 294 with a portion of the second housing 282 of the drive section 202, with the longitudinal axis 294 being adjustable with respect to the longitudinal axis 292. The angle between the longitudinal axes 292 and 294 may comprise a bend angle 296 of the downhole tool 200. The power assembly 201 may comprise a rotor (not shown) that rotates and generates torque in response to a drilling fluid flowing through it. As will be described in greater detail below, this rotation and torque may be transmitted to a drive shaft (not shown) at least partially disposed within the drive assembly 202, with the torque being transmitted through the drive shaft to a drill bit and selectively transmitted to the second housing 282 to alter the longitudinal axis 294 and, as a result, the bend angle 296 of the motor 200.

Figure 3:
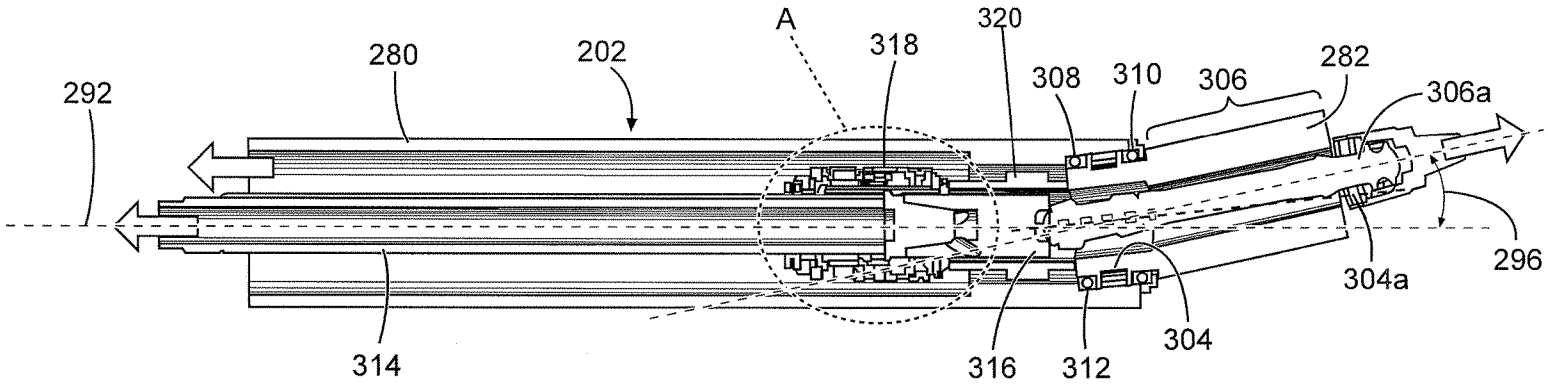
FIG. 3 is a diagram of a portion of an example downhole motor, according to aspects of the present disclosure.

FIG. 3 is a diagram illustrating a cross-section of the drive assembly 202 embodiment shown in FIG. 2, according to aspects of the present disclosure. In the embodiment shown, second housing 282 comprises a first portion 304 characterized by a first portion longitudinal axis 304*a* and a second portion 306 characterized by a second portion longitudinal axis 306*a*. The longitudinal axes 304*a* and 306*a* are non-parallel, representing a bend in the second housing 282. The bend in the second housing 282 may comprise a fixed bend, included in the housing during a manufacturing process. The first and second portions 304/306 may be integrally formed in the same housing 282, or may be physically separate portions that are attached at a joint, such as a threaded connection.

As described above, the second housing 282 may be rotatably coupled to the first housing 280. In the embodiment shown, the first portion 304 of the second housing 282 is at least partially within the first housing 280, with at least one set of bearings 308 allowing the second housing 282 to rotate with respect to the first housing 280. A retainer 310 may maintain the axial position of the second housing 282 with respect to the first housing 280 while still allowing the second housing 282 to be rotated with respect to the first housing 280. In certain embodiments, the retainer 310 may further function as a seal that prevents drilling and formation fluids from entering the first housing 280 past the bearings 308.

The first portion 304 of the second housing 282 may be arranged in a fixed, non-parallel longitudinal orientation with the first housing 280. In the embodiment shown, the first portion 304 of the second housing 282 is arranged in a machined slot 312 in the first housing 280. The machined slot 312 may maintain the first portion longitudinal axis 304*a* in a fixed, non-parallel position with respect to the longitudinal axis 292 of the first housing 280. When the second housing 282 rotates with respect to the first housing 280, it may rotate around the first portion longitudinal axis 304*a*, such that the second portion longitudinal axis 306*a* changes with respect to the longitudinal axis 292 of the first housing 280, but the relative position of the first portion longitudinal axis 304*a* with respect to the longitudinal axis 292 remains fixed. Accordingly, by altering the rotational orientation of the second housing 282 with respect to the first housing 280, the relative position of the second portion longitudinal axis 306*a* with respect to the longitudinal axis 292 can be altered, thereby altering the bend angle 296 of the motor 200 and the inclination of an attached drill bit.

In the embodiment shown, a drive shaft 314 is at least partially within the first housing 280. The drive shaft 314 is coupled to a constant velocity joint 316, which may transmit torque from the drive shaft 314, through the second housing 282 to an attached drill bit (not shown). As described above, the drive shaft 314 may be coupled to a power section (not shown) that may convert drilling fluid flow into a torque force that is then transferred to the drive shaft 314 and drill bit. According to aspects of the present disclosure, a selectively engageable torque coupling 318 positioned within the first housing 280 may selectively provide torque from the drive shaft 314 to the second housing 282, such as through an intermediate torsion coupling 320. In the embodiment shown, the selectively engageable torque coupling 318 is positioned around an end portion of the drive shaft 314 within the first housing 280. This is merely an exemplary embodiment, however, and the selectively engageable torque coupling 318 may be moved to other locations and take other arrangements and still fall within the scope of the present disclosure.

Advantageously, the selectively engageable torque coupling 318 may allow for the bend angle of the motor 200 to be altered using only the torque from the drive shaft 314, without requiring a secondary power source to drive the rotation of the second housing 282 with respect to the first housing 280. In certain embodiments, the selectively engageable torque coupling 318 may be coupled to a controller or information handling system at the surface or downhole that may send trigger signals to the coupling 318 that cause it to engage, transmit torque from the drive shaft 314, rotate the second housing 282, and alter the bend angle 296; or disengage and allow the drive shaft 314 to rotate without also rotating the second housing 282, leaving the bend angle 296 fixed.

Figure 4:
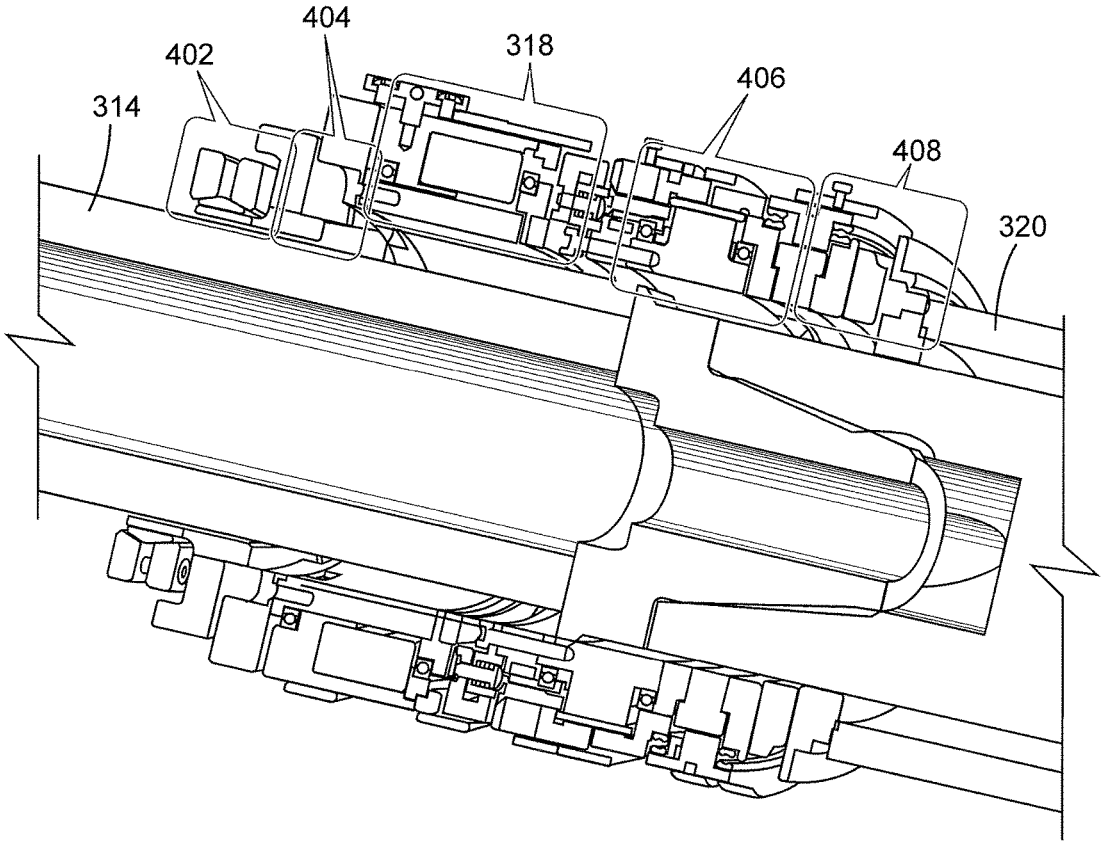
FIG. 4 is a diagram of a portion of an example downhole motor, according to aspects of the present disclosure.

FIG. 4 is a diagram illustrating a close-up view of section A from FIG. 3, according to aspect of the present disclosure. The selectively engageable torque coupling 318 may comprise a clutch that may be coupled directly or indirectly on one side to the drive shaft 314, coupled directly or indirectly on another side to the second housing 282, and selectively actuated to transfer torque between the drive shaft 314 and the second housing 282. In certain embodiments, the clutch may transmit torque when engaged and may include brake plates that prevent the second housing 282 from rotating when the clutch is not engaged. In other embodiments, a secondary brake mechanism may be included and released when the clutch is engaged. The clutch described herein is only one example of a selectively engageable torque couplings; other types of would be appreciated by one of ordinary skill in the art in view of this disclosure.

In the embodiment shown, a taper-lock ring 402 is coupled between the drive shaft 314 and the coupling 318, such that rotation of the drive shaft 314 causes the taper-lock ring 402 to rotate at the same revolutions per minute as the drive shaft 314. The taper-lock ring 402 may be coupled directly to the coupling 318 or may be coupled indirectly to the coupling 318, such as through an Oldham coupling 404. Oldham coupling 404 may comprise three discs, one coupled to an input, such as the taper-lock ring 402; one coupled to an output, such as the clutch 318; and a middle disc that is joined to the first two by tongue and groove. The middle disc may rotate around its center at the same speed as the input and output shafts, its center tracing a circular orbit around the midpoint between input and output shafts. The orbit of the middle disc may correct for any misalignment in the drive shaft 318 and second housing 282 that may cause unintentional deflections in the inclination of an attached drill bit.

In the embodiment shown, a harmonic gear box 406 is coupled between the coupling 318 and the second housing 282. As described above, altering the bend angle between the first housing 280 and second housing 282 may include rotating the second housing 282 with respect to the first housing 280 using torque from the drive shaft 314. In many instances, however, the drive shaft 314 may be rotating too fast to accurately rotate the second housing 282 to a desired orientation with respect to the first housing 280. When the coupling 318 is engaged and transmitting torque from the drive shaft 314, the gear box 406 may receive the rotation/torque at an input and, through one or more gears, output rotation/torque that is slower and easier to control, allowing for finer control of the rotational orientation of the second housing 282 with respect to the first housing 280, and therefore the bend angle between the housings. In certain instances, there may be a secondary Oldham coupling 408 between the gear box 406 and the second housing, to reduce misalignments on the second housing side of the clutch 318. Although a harmonic gear box 406 is described herein, any known torque/speed reducer may be used instead to provide control of the rotational orientation of the second housing 282 with respect to the first housing 280.

Figure 5A:
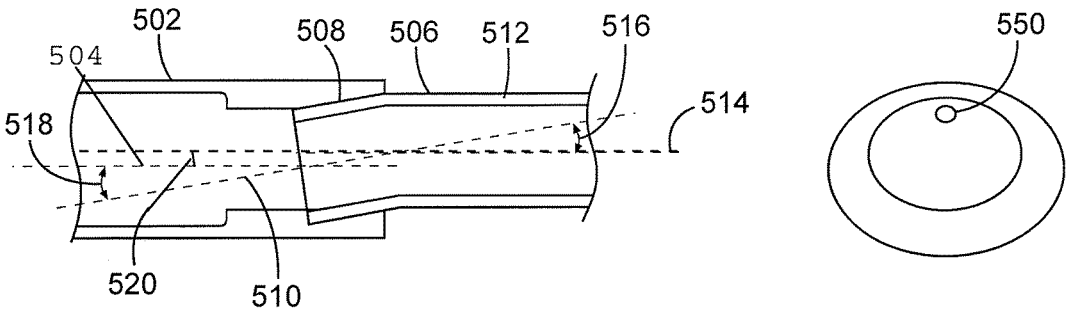
FIGS. 5A and 5B are diagrams of a portion of an example downhole motor, according to aspects of the present disclosure.
Figure 5B:
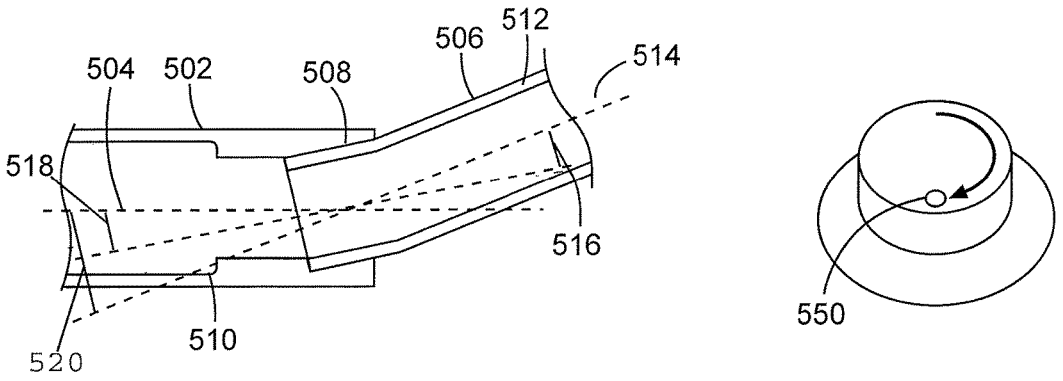

FIGS. 5A and 5B are simplified diagrams illustrating how the rotational orientation of a second housing with respect to a first housing alters the bend angle between the first and second housings, according to aspects of the present disclosure. Specifically, FIGS. 5A and 5B, illustrate a first housing 502 with a first housing longitudinal axis 504, and a second housing 506 that is rotationally coupled to the first housing 502. The second housing 506 has a first portion 508 with a first portion longitudinal axis 510, and a second portion 512 with a second portion longitudinal axis 514. The first portion longitudinal axis 510 differs from the second portion longitudinal axis 514 by an offset angle 516, and the first portion longitudinal axis 510 differs from the first housing longitudinal axis 504 by an offset angle 518. The angle 520 between the first housing longitudinal axis 504 and the second portion longitudinal axis 514 may comprise a bend angle.

According to aspects of the present disclosure, the absolute value of the offset angle 516 between the first portion longitudinal axis 510 and the second portion longitudinal 514 may be substantially the same as the absolute value of the offset angle 518 between the first portion longitudinal axis 510 and the first housing longitudinal axis 504. When the offset angles 516 and 518 are the same, the second housing 506 may be rotationally oriented with respect to the first housing 502 such that the bend angle 520 ranges from 0 degrees to two times the offset angle. FIG. 5A illustrates a "straight-ahead" drilling embodiment in which the bend angle 520 is essentially zero, when the second housing 506 is at a first rotational orientation illustrated by reference point 550. As can be seen, the offset angle 518 is essentially cancelled out by the offset angle 516 due to the rotational orientation of the second housing 506, making the first housing longitudinal axis 504 substantially parallel with the second portion longitudinal axis 514 such that an attached drill bit will drill in a straight-ahead direction with respect to an attached drill string.

As the second housing 506 is rotated with respect to the first housing 502, the bend angle 520 may range from zero to a maximum of twice the offset angle 518. Referring to FIG. 5B, the maximum bend angle may be achieved when the second housing 506 is rotated 180 degrees from the rotational orientation shown in FIG. 5A. Specifically, rather than canceling out offset angle 516, the rotational orientation of the second housing in FIG. 5B causes the offset angle 518 to combine with offset angle 516 to provide the maximum bend angle for the configuration. Notably, the bend angle 520 may increase linearly and continuously as the second housing 506 is rotated towards the rotational orientation in FIG. 5B, and decrease linearly and continuously as the second housing 506 is rotated away from the rotational orientation in FIG. 5B. Accordingly, any bend angle between 0 and twice the offset angle may be selected by correlating the rotational orientation of the second housing 506 with the range of possible bend angles.

In certain embodiments, one or more downhole controllers, such as in a BHA, may be communicably coupled to the second housing 506 and may track the rotational orientation or "tool face angle" of the second housing 506. The downhole controller may also include one or more stored instructions that correlate the rotational orientation of the second housing 506 with a bend angle, accounting for the actual range of bend angles provided by the physical embodiments of the first and second housings. The downhole controller may receive commands from a surface information handling system to alter the bend angle to a pre-determined angle, at which point the downhole controller may determine the rotational orientation of the second housing 506 that correlates with that bend angle, issue an engage command to a selectively engageable torque coupling to cause the second housing 506 to rotate, track the rotational orientation of the second housing 506 as it rotates, and issue a disengage command to the selectively engageable torque coupling to cause the second housing 506 to stop rotating and stay fixed at the desired rotational orientation/bend angle. In certain other embodiments, a different combination of downhole and surface controllers as well as commands may be used to track and alter the rotational orientation of the second housing 506.

One advantage of the downhole motor described herein is that the bend angle can be adjusted while the drilling assembly is located downhole, saving the time and expense of tripping out the drilling assembly to alter the bend angle. According to aspects of the present disclosure, an example method for altering the bend angle may include stopping the drilling operation by stopping the flow of drilling fluid into the borehole and lifting up the drilling assembly to free a drill bit of the drilling assembly from the formation. Once freed, drilling fluid can again be pumped downhole, causing the power section of the downhole motor to rotate a drive shaft in the motor. The selectively engageable torque coupling can be engaged to transfer torque to the second housing, which may rotate until a desired rotational orientation has been achieved. When the desired rotational orientation is reached, the clutch can be disengaged, brake plates or some other braking force can be automatically or manually engaged to maintain the orientation of the second housing, and drilling can commence with the altered bend angle.

Figure 6:
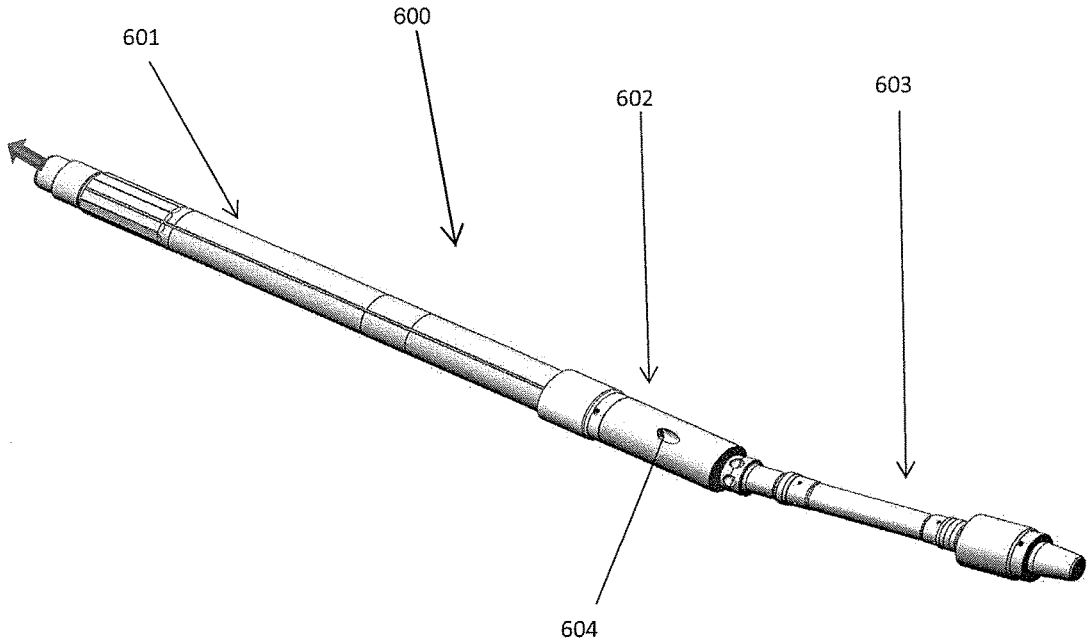
FIG. 6 is a diagram of an example drive train for use an example downhole motor, according to aspects of the present disclosure.

FIG. 6 is a diagram of an example drive train 600 for use an example downhole motor, according to aspects of the present disclosure. The drive train 600 comprises a drive shaft 601 which may be connected at one end to the power section of a downhole motor, such as a fluid driven turbine, as described above. In certain embodiments, the drive shaft 601 may be connected at another end to a drive shaft cap 602, which acts as an intermediary between the drive shaft 601 and a CV-joint section 603. Notably, the drive shaft cap 602 may comprise or be coupled to a tie rod assembly that provides the flexibility to transfer drilling torque from input axis of the drive shaft 601 to the oriented output tool face axis of the second housing. In certain embodiments, drilling mud may flow through a central bore of the drive shaft 601 and be routed by drive shaft diverter holes 604 to an annulus where it travels to and exits from a drill bit.

According to aspects of the present disclosure, an example downhole motor may comprise a first housing and a second housing with first and second portions characterized by non-parallel longitudinal axes. The second housing is rotatably coupled to the first housing, and the first portion of the second housing is arranged in a fixed, non-parallel longitudinal orientation with the first housing. A drive shaft may be at least partially within the first housing, and a the motor may further comprise a selectively engageable torque coupling between the drive shaft and the second housing, positioned within the first housing.

In certain embodiments, the first portion of the second housing may comprise a first portion longitudinal axis, and the second portion of the second housing may comprise a second portion longitudinal axis. The first portion longitudinal axis may differ from the second portion longitudinal axis by an offset angle. In certain embodiments, the first housing comprises a first housing longitudinal axis, and the first portion longitudinal axis may differ from the first housing longitudinal axis by the offset angle.

In any of the embodiments described in the preceding two paragraphs, the downhole motor may comprise a taper-lock ring coupled between the drive shaft and the selectively engageable torque coupling. The motor may further comprise an Oldham coupling between the taper-lock ring and the selectively engageable torque coupling.

In any of the embodiments described in the preceding three paragraphs, the downhole motor may comprise a torsional coupling between the selectively engageable torque coupling and the second housing. The downhole motor may further comprise at least one of a harmonic gear box and an Oldham coupling between the selectively engageable torque coupling and the torsional coupling.

In any of the embodiments described in the preceding four paragraphs, the selectively engageable torque coupling may comprise a clutch.

In any of the embodiments described in the preceding five paragraphs, the downhole motor may further comprise a power section consisting of a rotor and a stator, wherein the first housing is coupled to the stator and the drive shaft is coupled to the rotor. In certain embodiments, the downhole motor may further comprise a drill bit coupled to the drive shaft through a constant velocity joint assembly at least partially within the second housing.

According to aspects of the present disclosure, an example method for drilling using a downhole motor may comprise rotating a drill bit in a borehole using a downhole motor with a first bend angle, and rotating a second housing of the downhole motor with respect to a first housing of the downhole motor to change the first bend angle to a second bend angle while the downhole motor is within the borehole. The method may further include rotating the drill bit in the borehole using the downhole motor with the second bend angle. In certain embodiments, rotating the drill bit in the borehole using the downhole motor with the first bend angle may comprise rotating the drill bit with a drive shaft at least partially disposed within a first housing of the downhole motor. The first bend angle may comprise a first angle between a longitudinal axis of the first housing and a longitudinal axis of a portion of the second housing.

In any of the embodiments described in the preceding paragraph, the second housing may comprise first and second portions characterized by non-parallel longitudinal axes. The second housing may be rotatably coupled to the first housing, and the longitudinal axis of the portion of the second housing may comprise a longitudinal axis of the second portion of the second housing. In certain embodiments, rotating the second housing of the downhole motor with respect to the first housing of the downhole motor may comprise rotating the second housing about a longitudinal axis of the first portion of the second housing. The second bend angle may comprise a second angle between the first housing longitudinal axis and the second portion longitudinal axis of the second housing.

In any of the embodiments described in the preceding two paragraphs, rotating the second housing of the downhole motor with respect to the first housing of the downhole motor may comprise engaging a selectively engageable torque coupling between a drive shaft of the downhole motor and the second housing. In certain embodiments, rotating the second housing of the downhole motor with respect to the first housing of the downhole motor may further comprise rotating the drive shaft by directing a flow of drilling fluid through the downhole motor. In certain embodiments, engaging a selectively engageable torque coupling between a drive shaft of the downhole motor and the second housing may comprise receiving a command to alter a bend angle of the downhole motor and issuing a trigger to the selectively engagable torque coupling.

In any of the embodiments described in the preceding three paragraphs, the selectively engageable torque coupling may comprise a clutch. In certain embodiments, rotating the second housing of the downhole motor with respect to the first housing of the downhole motor may further comprise determining a rotational orientation of the second housing. In certain embodiments, rotating the second housing of the downhole motor with respect to the first housing of the downhole motor may further comprise disengaging the selectively engageable torque coupling between the drive shaft and the second housing when the second housing reaches a pre-determined rotational orientation.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A downhole motor, comprising:

a first housing;

a second housing with first and second portions characterized by non-parallel longitudinal axes, wherein the second housing is rotatably coupled to the first housing;

the first portion of the second housing is arranged in a fixed, non-parallel longitudinal orientation with the first housing;

the first housing comprises a first housing longitudinal axis; and the second portion of the second housing comprises a second portion longitudinal axis;

a drive shaft at least partially within the first housing; and a selectively engageable torque coupling between the drive shaft and the second housing, positioned within the first housing; and wherein rotation of the second housing about a longitudinal axis of the first portion of the second housing with respect to the first housing changes a first bend angle of the downhole motor to a second bend angle of the downhole motor, wherein the first bend angle comprises a first angle between a longitudinal axis of the first housing and a longitudinal axis of a second portion of the second housing, and wherein the second bend angle comprises a second angle between the first housing longitudinal axis and the second portion longitudinal axis of the second housing.

2. The downhole motor of claim 1, wherein the first portion of the second housing comprises a first portion longitudinal axis; and the first portion longitudinal axis differs from the second portion longitudinal axis by an offset angle.

3. The downhole motor of claim 2, wherein the first portion longitudinal axis differs from the first housing longitudinal axis by the offset angle.

4. The downhole motor of claim 1, further comprising a taper-lock ring coupled between the drive shaft and the selectively engageable torque coupling.

5. The downhole motor of claim 4, further comprising an Oldham coupling between the taper-lock ring and the selectively engageable torque coupling.

6. The downhole motor of claim 1, further comprising a torsional coupling between the selectively engageable torque coupling and the second housing.

7. The downhole motor of claim 6, further comprising at least one of a harmonic gear box and an Oldham coupling between the selectively engageable torque coupling and the torsional coupling.

8. The downhole motor of claim 1, wherein the selectively engageable torque coupling comprises a clutch.

9. The downhole motor of claim 1, further comprising a power section consisting of a rotor and a stator, wherein the first housing is coupled to the stator and the drive shaft is coupled to the rotor.

10. The downhole motor of claim 9, further comprising a drill bit coupled to the drive shaft through a constant velocity joint assembly at least partially within the second housing.

11. A method for drilling using a downhole motor, comprising:

rotating a drill bit in a borehole using a downhole motor with a first bend angle;

rotating a second housing of the downhole motor with respect to a first housing of the downhole motor to change the first bend angle to a second bend angle while the downhole motor is within the borehole;

rotating the drill bit in the borehole using the downhole motor with the second bend angle;

rotating the drill bit in the borehole using the downhole motor with the first bend angle comprises rotating the drill bit with a drive shaft at least partially disposed within the first housing of the downhole motor;

the first bend angle comprises a first angle between a longitudinal axis of the first housing and a longitudinal axis of a portion of the second housing; and wherein:

the first housing comprises a first housing longitudinal axis;

the second housing comprises a first portion and a second portion, wherein the first portion and the second portion are characterized by non-parallel longitudinal axes;

the second housing is rotatably coupled to the first housing;

the second portion of the second housing comprises a second portion longitudinal axis;

rotating the second housing of the downhole motor with respect to the first housing of the downhole motor comprises rotating the second housing about a longitudinal axis of the first portion of the second housing; and the second bend angle comprises a second angle between the first housing longitudinal axis and the second portion longitudinal axis of the second housing.

12. The method of claim 11, wherein rotating the second housing of the downhole motor with respect to the first housing of the downhole motor comprises engaging a selectively engageable torque coupling between a drive shaft of the downhole motor and the second housing.

13. The method of claim 12, wherein rotating the second housing of the downhole motor with respect to the first housing of the downhole motor further comprises rotating the drive shaft by directing a flow of drilling fluid through the downhole motor.

14. The method of claim 12, wherein engaging a selectively engageable torque coupling between a drive shaft of the downhole motor and the second housing comprises receiving a command to alter a bend angle of the downhole motor and issuing a trigger to the selectively engageable torque coupling.

15. The method of claim 14, wherein the selectively engageable torque coupling comprises a clutch.

16. The method of claim 14, wherein rotating the second housing of the downhole motor with respect to the first housing of the downhole motor further comprises determining a rotational orientation of the second housing.

17. The method of claim 16, wherein rotating the second housing of the downhole motor with respect to the first housing of the downhole motor further comprises disengaging the selectively engageable torque coupling between the drive shaft and the second housing when the second housing reaches a pre-determined rotational orientation.

* * * * *